US010665174B2

(12) United States Patent
Park

(10) Patent No.: US 10,665,174 B2
(45) Date of Patent: May 26, 2020

(54) ORGANIC LIGHT EMITTING DIODE DISPLAY AND COMPENSATION METHOD OF DRIVING CHARACTERISTICS THEREOF

(71) Applicant: LG Display Co., Ltd., Seoul (KR)

(72) Inventor: Joonmin Park, Seoul (KR)

(73) Assignee: LG Display Co., Ltd., Seoul (KR)

( * ) Notice: Subject to any disclaimer, the term of this patent is extended or adjusted under 35 U.S.C. 154(b) by 0 days.

(21) Appl. No.: 15/717,868

(22) Filed: Sep. 27, 2017

(65) Prior Publication Data

US 2018/0151129 A1 May 31, 2018

(30) Foreign Application Priority Data

Nov. 30, 2016 (KR) ..... 10-2016-0161557

(51) Int. Cl.
*G09G 3/3291* (2016.01)
*G09G 3/3233* (2016.01)

(52) U.S. Cl.
CPC ..... *G09G 3/3291* (2013.01); *G09G 3/3233* (2013.01); *G09G 2300/043* (2013.01);
(Continued)

(58) Field of Classification Search
CPC .. G09G 3/3233; G09G 3/3648; G09G 3/3291; G09G 2320/043; G09G 2320/0233; G09G 2320/0295; G09G 2320/045; G09G 2300/0861; G09G 2300/0426; G09G 2300/043
See application file for complete search history.

(56) References Cited

U.S. PATENT DOCUMENTS 8,576,217 B2 11/2013 Chaji et al.
9,218,768 B2 12/2015 Lee
(Continued)

FOREIGN PATENT DOCUMENTS

CN 103714777 A 4/2014
CN 104732920 A 6/2015
KR 10-2015-0076028 A 7/2015

OTHER PUBLICATIONS

Office Action, Intellectual Property India Patent Application No. 201714042211, dated Oct. 21, 2019, 6 pages.
(Continued)

*Primary Examiner* — Dong Hui Liang
(74) *Attorney, Agent, or Firm* — Fenwick & West LLP

(57) ABSTRACT

An organic light emitting diode display and a compensation method of driving characteristics thereof are discussed. The organic light emitting diode display includes a first pixel connected to a reference voltage line and a first data line, a second pixel sharing the reference voltage line and connected to a second data line, a data driver configured to output a data voltage to first and second output channels during a display period and acquire a sensing voltage of the first and second pixels through the reference voltage line during a compensation period, a first switch connected between the first output channel and the first data line, and a second switch connected between the second output channel and the second data line. The second switch is turned off during a first compensation period for detecting driving characteristic of the first pixel.

7 Claims, 8 Drawing Sheets

(52) U.S. Cl.
CPC ... *G09G 2310/08* (2013.01); *G09G 2320/029* (2013.01); *G09G 2320/0233* (2013.01); *G09G 2320/045* (2013.01)

(56) References Cited

U.S. PATENT DOCUMENTS

| | | | | |
|---|---|---|---|---|
| 9,607,553 | B2 | 3/2017 | Park | |
| 9,761,177 | B2 | 9/2017 | Mizukoshi | |
| 2008/0012815 | A1* | 1/2008 | Kawata | G09G 3/006 345/98 |
| 2008/0170010 | A1* | 7/2008 | Kim | G09G 3/3233 345/76 |
| 2013/0106819 | A1* | 5/2013 | Lee | G09G 3/003 345/211 |
| 2014/0022289 | A1* | 1/2014 | Lee | G09G 3/3283 345/691 |
| 2014/0092076 | A1 | 4/2014 | Lee | |
| 2015/0179105 | A1 | 6/2015 | Mizukoshi | |
| 2015/0187267 | A1* | 7/2015 | Park | G09G 3/3233 345/77 |
| 2015/0187268 | A1* | 7/2015 | Tani | G09G 3/3233 345/77 |
| 2015/0187278 | A1 | 7/2015 | Park | |
| 2015/0192621 | A1 | 7/2015 | Nathan et al. | |
| 2015/0379937 | A1 | 12/2015 | Kim et al. | |

OTHER PUBLICATIONS

First Office Action, China National Intellectual Property Adminstration Patent Application No. 201710897563.9, dated Apr. 3, 2020, 23 pages.

* cited by examiner

ORGANIC LIGHT EMITTING DIODE DISPLAY AND COMPENSATION METHOD OF DRIVING CHARACTERISTICS THEREOF

CROSS-REFERENCE TO RELATED APPLICATIONS

This application claims the priority benefit of Republic of Korea Patent Application No. 10-2016-0161557 filed on Nov. 30, 2016, the entire contents of which is incorporated herein by reference in its entirety.

BACKGROUND

Field of Technology

The present disclosure relates to an active matrix type organic light emitting diode display, and more particularly, an organic light emitting diode display and a compensation method of driving characteristics thereof.

Discussion of the Related Art

An active matrix organic light emitting diode display includes an organic light emitting diode (OLED) capable of emitting light by itself and has many advantages, such as a fast response time, a high emission efficiency, a high luminance, a wide viewing angle, and the like.

The OLED serving as a self-emitting element includes an anode electrode, a cathode electrode, and an organic compound layer between the anode electrode and the cathode electrode. The organic compound layer includes a hole injection layer HIL, a hole transport layer HTL, an emission layer EML, an electron transport layer ETL, and an electron injection layer EIL. When a driving voltage is applied to the anode electrode and the cathode electrode, holes passing through the hole transport layer HTL and electrons passing through the electron transport layer ETL move to the emission layer EML and form excitons. As a result, the emission layer EML generates visible light.

Each of pixels of the organic light emitting diode display includes a driving thin film transistor (TFT) for controlling a driving current flowing in the OLED. Though it is preferable that electrical characteristics of the driving TFT such as a threshold voltage, a mobility, etc. are designed to be the same in all pixels, the electrical characteristics of the driving TFT in each pixel are not uniform actually due to process conditions, driving environment, and the like. For this reason, the driving current depending on the same data voltage varies from pixel to pixel. As a result, a luminance deviation occurs between the pixels. To solve this problem, there is known an image quality compensation technique which senses characteristic parameters (for example, a threshold voltage and a mobility) of the driving TFT from each pixel and appropriately corrects input data with the sensed result, thereby reducing luminance unevenness.

An external compensation method for reflecting an amount of change in the threshold voltage of the driving TFT among the image quality compensation techniques is known. A method of extracting the amount of change in the threshold voltage includes operating the driving TFT in a source follower manner and then receiving a source voltage of the driving TFT as a sensing voltage and detecting the amount of change in the threshold voltage of the driving TFT based on the sensing voltage. The amount of change in the threshold voltage of the driving TFT is determined depending on a magnitude of the sensing voltage, thereby obtaining an offset value for data compensation.

In general, a process of extracting the amount of change in the threshold voltage of the driving TFT is performed in a pixel unit at the same time.

Recently, a pixel structure in which two or more adjacent pixels share a reference voltage line has been proposed. In the pixel structure sharing the reference voltage line, the sensing voltage of the pixels connected to the reference voltage line is sequentially extracted. As described above, in the process of sequentially extracting the sensing voltage of each pixel using one reference voltage line, it is difficult to extract an accurate sensing voltage when a short circuit occurs between the reference voltage line and a data line.

SUMMARY

In one aspect, there is provided an organic light emitting diode display including a first pixel, a second pixel, a data driver, a first switch, and a second switch. The first pixel is connected to a reference voltage line and a first data line. The second pixel shares the reference voltage line and is connected to a second data line. The data driver is configured to output a data voltage to first and second output channels during a display period and acquire a sensing voltage of the first and second pixels through the reference voltage line during a compensation period. The first switch connected between the first output channel and the first data line. The second switch connected between the second output channel and the second data line. The second switch is turned off during a first compensation period for detecting driving characteristic of the first pixel.

In another aspect, there is provided a compensation method of driving characteristics of an organic light emitting diode display including a first pixel connected to a reference voltage line and a first data line and a second pixel sharing the reference voltage line and connected to a second data line including a first compensation period and a second compensation period. The compensation method includes the first compensation period for detecting a threshold voltage of a driving transistor belonging to the first pixel while floating the second data line and the second compensation period for detecting a threshold voltage of a driving transistor belonging to the second pixel while floating the first data line.

BRIEF DESCRIPTION OF THE DRAWINGS

The accompanying drawings, which are included to provide a further understanding of the invention and are incorporated in and constitute a part of this specification, illustrate embodiments of the invention and together with the description serve to explain the principles of the invention. In the drawings.

DETAILED DESCRIPTION

Hereinafter, different embodiments of the disclosure will be described in detail with reference to the accompanying drawings. Like numbers refer to like elements throughout the specification. In the following description, when it is determined that the detailed description of known functions or configurations related to the invention may unnecessarily obscure the gist of the invention, a detailed description thereof will be omitted.

Hereinafter, different embodiments of the disclosure will be described with reference to FIGS. 1 to 7C.

Figure 1:
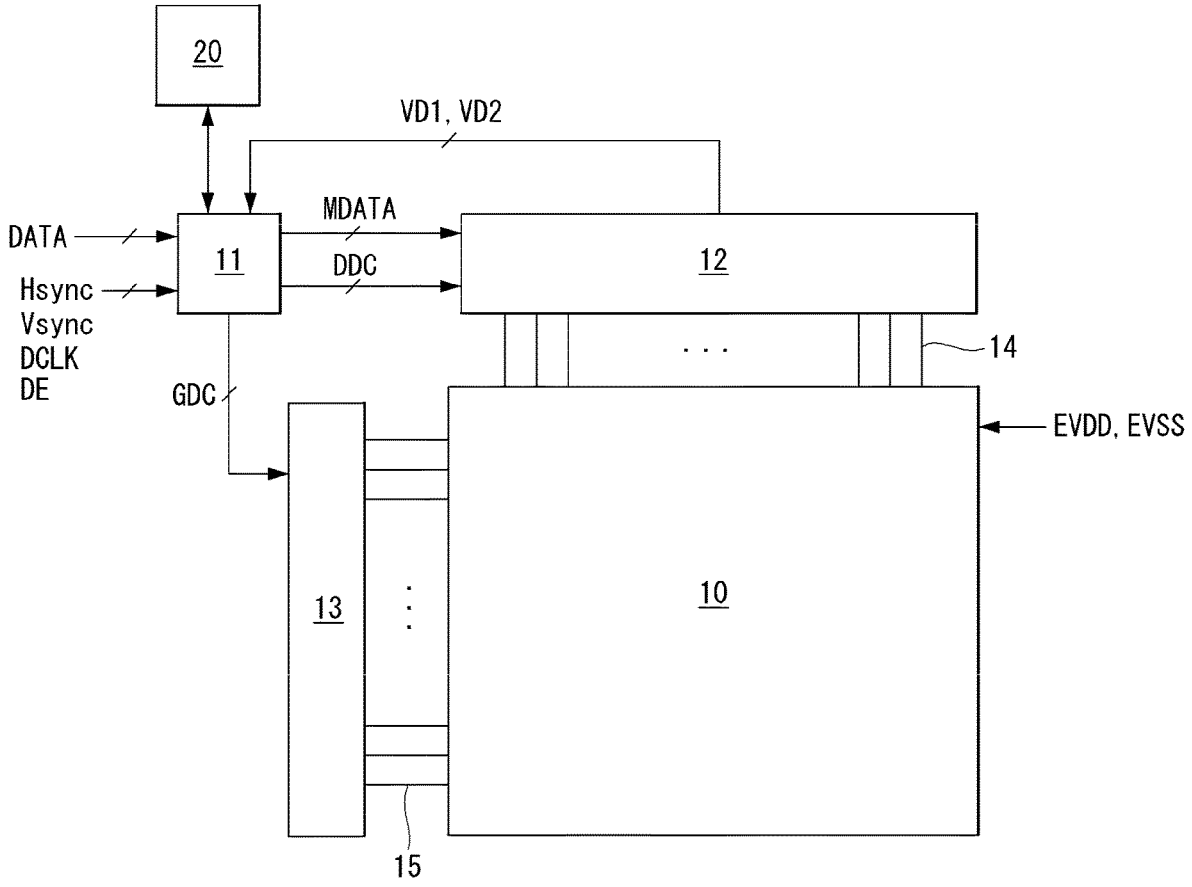
FIG. 1 is a diagram illustrating an organic light emitting diode display according to an embodiment of the disclosure.
Figure 2:
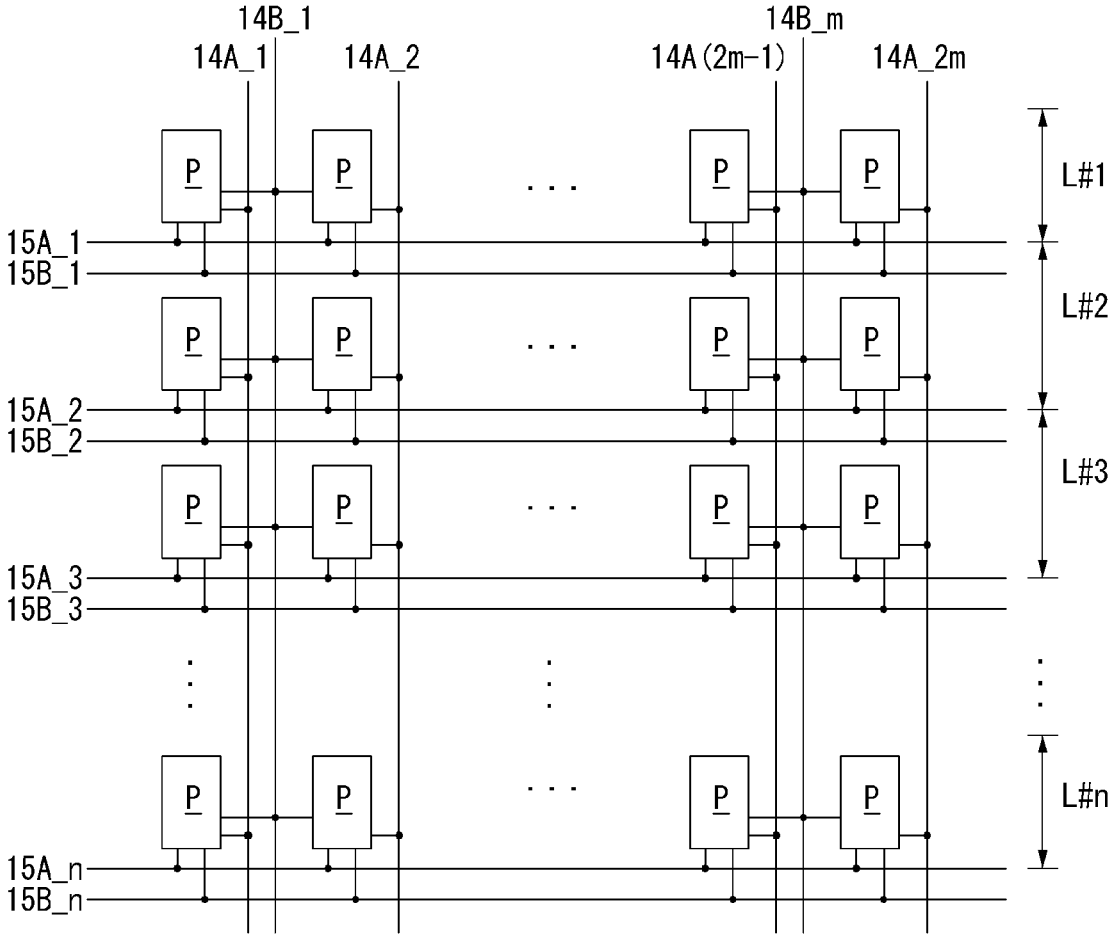
FIG. 2 illustrates a pixel array formed on a display panel of FIG. 1 according to an embodiment of the disclosure.

FIG. 1 is a diagram illustrating an organic light emitting diode display according to an embodiment of the disclosure. FIG. 2 illustrates a pixel array formed on a display panel of FIG. 1.

Referring to FIGS. 1 and 2, the organic light emitting diode display according to an embodiment of the disclosure includes a display panel 10, a data driver 12, a gate driver 13, and a timing controller 11.

In the display panel 10, a plurality of data line portions 14 and a plurality of gate lines 15 intersect with each other, and pixels P are arranged in a matrix form in each of the intersection regions. 2m (m is a positive integer) number of the pixels P are arranged in each of horizontal lines L #1 to L # n. The data line portions 14 include 2m data lines 14A_1 to 14A_2*m* and m reference voltage lines 14B_1 to 14B_m. The gate lines 15 include n (n is a positive integer) first gate lines 15A_1 to 15A_n and n second gate lines 15B_1 to 15B_n.

Each of the pixels P is supplied with a high potential driving voltage EVDD and a low potential driving voltage EVSS from a power generator not shown. The pixels P may include an organic light emitting diode (OLED), a driving transistor, a first transistor ST1, a second transistor ST2, and a storage capacitor for external compensation. The transistors constituting the pixels P may be implemented as a p-type or an n-type. In addition, a semiconductor layer of TFTs constituting the pixels P may include amorphous silicon, polysilicon, or an oxide.

Each pixel P is connected to one of the data lines 14A_1 to 14A_2*m*, one of the reference voltage lines 14B_1 to 14B_m, one of the first gate lines 15A_1 to 15A_n, and one of the second gate lines 15B_1 to 15B n. In a sensing driving for detecting an amount of change in a threshold voltage of the driving transistor, the pixels P sequentially operate by one horizontal line L #1 to L # n to output sensing voltages through the reference voltage lines 14B_1 to 14B_m in response to a first scan signal for sensing, which is supplied in a line sequential manner from the first gate lines 15A_1 to 15A_n and a second scan signal for sensing, which is supplied in a line sequential manner from the second gate lines 15B_1 to 15B_n. In an image display driving for displaying an image, the pixels P sequentially operate by one horizontal line L #1 to L # n to receive data voltages for displaying through the data lines 14A_1 to 14A_2*m* in response to a first scan signal for displaying, which is supplied in a line sequential manner from the first gate lines 15A_1 to 15A_n and a second scan signal for displaying, which is supplied in a line sequential manner from the second gate lines 15B_1 to 15B_n.

The data driver 12 supplies the pixels P with a data voltage for sensing that is synchronized with the first scan signal for sensing based on a data control signal DDC from the timing controller 11 during the sensing driving. Also the data driver 12 converts the sensing voltages inputted from the display panel 10 through the reference voltage lines 14B_1 to 14B_m into digital values and supplies the digital values to the timing controller 11. The data driver 12 converts a digital compensation data MDATA inputted from the timing controller 11 into the data voltages for displaying an image based on the data control signal DDC during the image display driving, and then supplies the data voltages for displaying to the data lines 14A_1 to 14A_2*m* in synchronization with the first scan signal for displaying.

The gate driver 13 generates a gate pulse based on a gate control signal GDC from the timing controller 11. The gate pulse may include the first scan signal for sensing, the second scan signal for sensing, the first scan signal for displaying, and the second scan signal for displaying. The gate driver 13 may supply the first scan signal for sensing to the first gate lines 15A_1 to 15A_n in a line sequential manner, and supply the second scan signal for sensing to the second to the second gate lines 15B_1 to 15B_n in a line sequential manner during the sensing driving. The gate driver 13 may supply the first scan signal for displaying to the first gate lines 15A_1 to 15A_n in a line sequential manner and supply the second scan signal for displaying to the second gate lines 15B_1 to 15B_n in a line sequential manner during the image display driving. The gate driver 13 may be formed directly on the display panel 10 in a gate-driver in panel (GIP) manner.

The timing controller 11 generates a data control signal DDC for controlling an operation timing of the data driver 12 and a gate control signal GDC for controlling an operation timing of the gate driver 13 based on timing signals such as a vertical synchronization signal Vsync, a horizontal synchronization signal Hsync, a dot clock signal DCLK, and a data enable signal DE. The timing controller 11 modulates an input digital video data DATA by referring to a first digital sensing value VD1 or a second digital sensing value VD2 supplied from the data driver 12, so that the timing controller 11 generates the digital compensation data MDATA for compensating a threshold voltage change and a mobility change of the driving transistor and then supplies the digital compensation data MDATA to the data driver 12.

The timing controller 11 extracts an amount of change of a threshold voltage of the driving transistor based on the a first digital sensing value VD1 or a second digital sensing value VD2 input from the data driver 12 during the sensing driving. The timing controller 11 determines an offset value for compensating the threshold voltage change of the driving transistor, and then applies the offset value to the input digital video data DATA to generate the digital compensation data MDATA to be applied to the pixel.

The memory 20 may store a reference voltage serving as a reference for deriving an amount of the mobility change and reference compensation values serving as a reference for determining the offset value.

Figure 3:
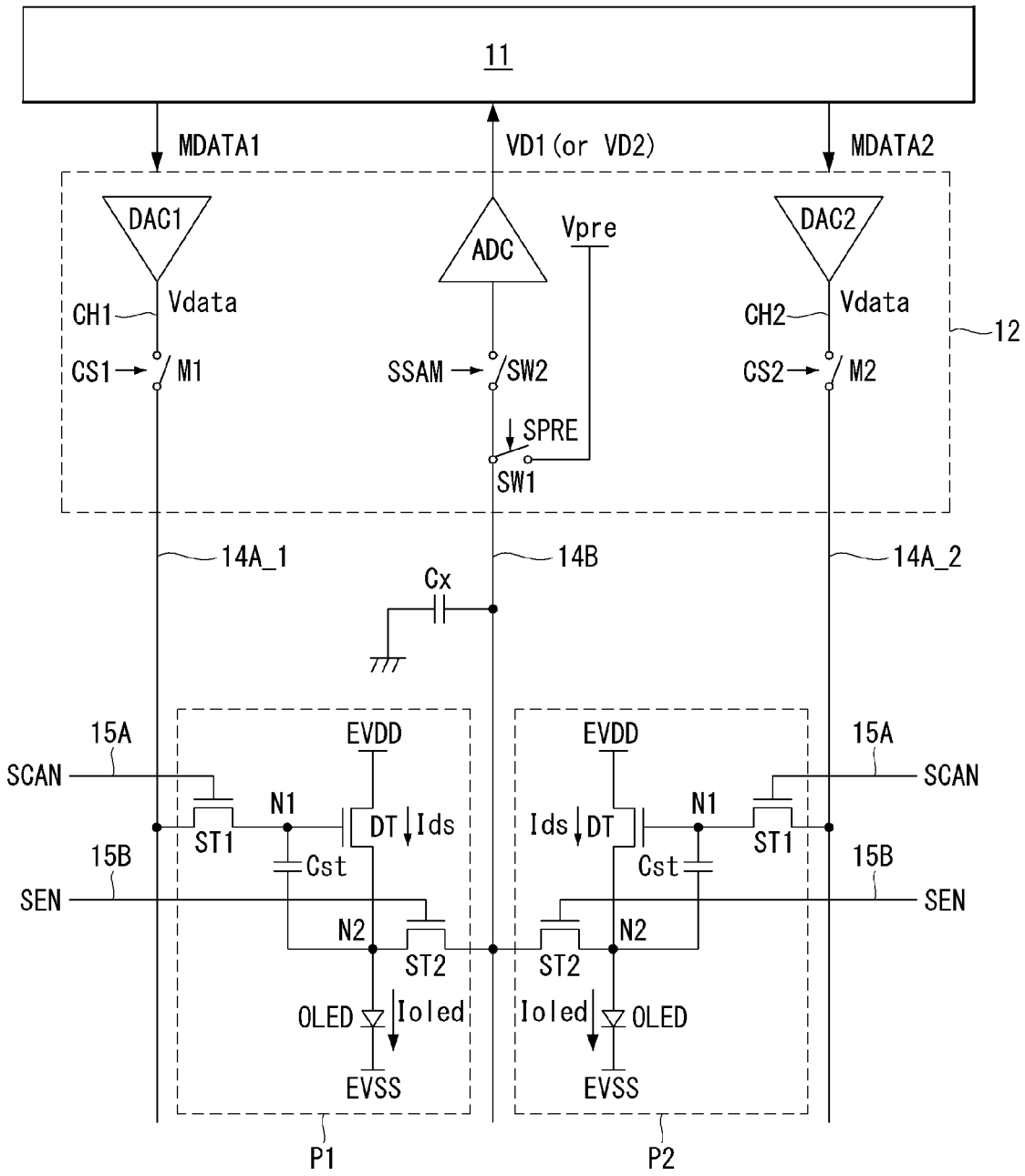
FIG. 3 is a diagram illustrating a specific circuit configuration of first and second pixels according to an embodiment of the disclosure.

FIG. 3 is a diagram illustrating an equivalent circuit of first and second pixels according to an embodiment of the disclosure. Particularly, FIG. 3 illustrates a specific circuit configuration of the first and second pixels for external compensation and a connection structure between each of the pixels and the timing controller and the data driver.

Referring to FIG. 3, the first and second pixels P1 and P2 are connected to first and second data lines 14A-1 and 14A_2, respectively, and share a reference voltage line 14B.

Each of the first and second pixels P1 and P2 may include an organic light emitting diode OLED, a driving transistor DT, a storage capacitor Cst, a first transistor ST1 and a second transistor ST2.

The organic light emitting diode OLED includes an anode electrode connected to a second node N2, a cathode electrode connected to an input terminal of a low potential driving voltage EVSS, and an organic compound layer disposed between the anode electrode and the cathode electrode.

The driving transistor DT controls a driving current Ioled flowing in the organic light emitting diode OLED depending on a gate-source voltage Vgs. The driving transistor DT includes a gate electrode connected to a first node N1, a drain electrode connected to an input terminal of a high potential driving voltage EVDD, and a source electrode connected to the second node N2.

The storage capacitor Cst is connected between the first node N1 and the second node N2.

The first transistor ST1 includes a gate electrode connected to an input terminal of a first scan signal SCAN, a drain electrode connected to the first data line 14A-1, and a source electrode connected to the first node N1.

The second transistor ST2 includes a gate electrode connected to an input terminal of a second scan signal SEN, a drain electrode connected to the second node N2, and a source electrode connected to the reference voltage line 14B.

The data driver 12 is connected to the pixels P1 and P2 through the data lines 14A-1 and 14A_2 and the reference voltage line 14B. The reference voltage line 14B may be formed with a sensing capacitor Cx for storing a source voltage of the second transistor ST2 as a first sensing voltage Vsen1 or a second sensing voltage Vsen2. The data driver 12 includes a digital-to-analog converter (DAC), an analog-to-digital converter (ADC), an initialization switch SW1, a sampling switch SW2, first and second switches M1 and M2, and the like.

The digital-to-analog converter (DAC) can generate a data voltage Vdata for sensing under a control of the timing controller 11 and output it to the data lines 14A-1 and 14A_2 during a sensing driving. The DAC can convert a digital compensation data into a data voltage Vdata for displaying under the control of the timing controller 11 and output it to the data lines 14A-1 and 14A_2 during an image display driving.

The initialization switch SW1 switches a current flow between an input terminal of an initialization voltage Vpre and the reference voltage line 14B in response to an initialization control signal SPRE. The sampling switch SW2 switches a current flow between the reference voltage line 14B and the ADC in response to a sampling control signal SSAM during the sensing driving. Thus, the sampling switch SW2 supplies the source voltage of the driving transistor DT stored in the sensing capacitor Cx of the reference voltage line 14B to the ADC as the sensing voltage Vsen for a predetermined time. The ADC converts an analog sensing voltage stored in the sensing capacitor Cx into a digital value Vsen and supplies it to the timing controller 11. The sampling switch SW2 maintains a turn-off state in response to the sampling control signal SSAM during the image display driving.

Figure 4:
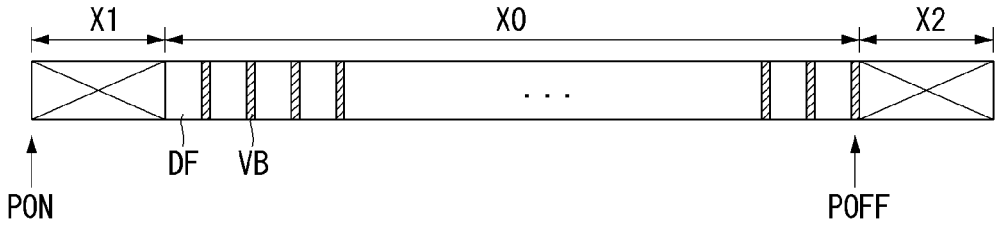
FIG. 4 is a diagram illustrating an image display period and a non-display period according to an embodiment of the disclosure.

FIG. 4 is a diagram illustrating a driving period of an organic light emitting diode display according to an embodiment of the invention.

Referring to FIG. 4, the driving period of the organic light emitting diode display according to an embodiment of the disclosure includes first and second non-display periods X1 and X2 and an image display period X0.

The first non-display period X1 may be defined as a period from an application time of a driving power-on signal PON to a time that several tens to several hundreds of frames elapse. The second non-display period X2 may be defined as a period from an application time of a driving power-off signal POFF to a time that several tens to several hundreds of frames elapse.

The image display period X0 includes a display period DF in which a data voltage is written to the pixels P and a vertical blank period VB in which no image data is written.

Figure 5:
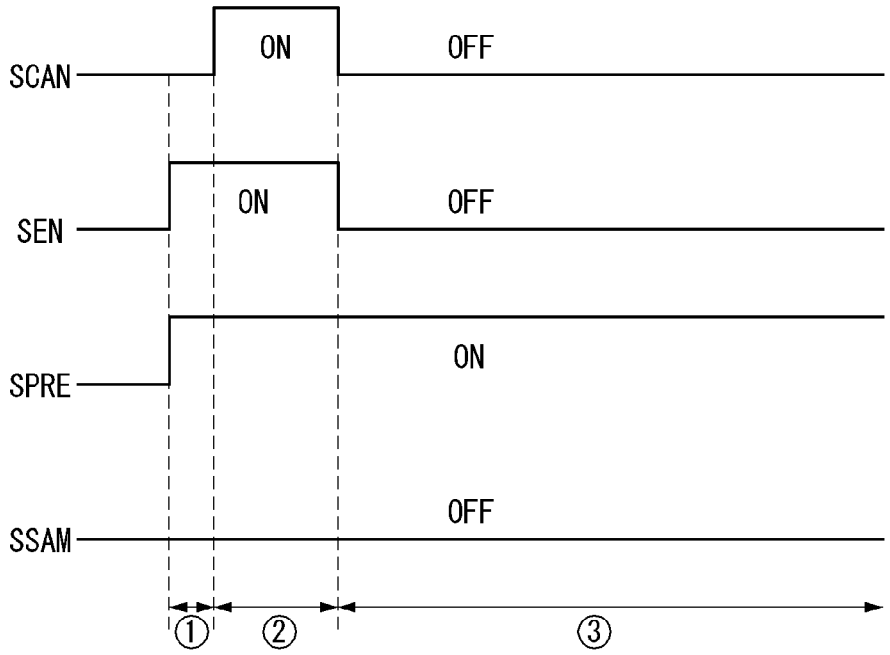
FIG. 5 is a diagram illustrating timings of control signals during a display period according to an embodiment of the disclosure.

FIG. 5 is a diagram illustrating timings of scan signals and switch control signals during a display period in an image display period.

An operation of the pixel P in the display period DF in conjunction with FIG. 3 and FIG. 5 will be described below. The operation of each pixel P in the display period DF is the same, and hereinafter, the operation will be described about one pixel P.

The operation in the display period according to an embodiment of the disclosure is divided into a period ①, a period ②, and a period ③.

During the display period, the initialization control signal SPRE maintains a gate-on voltage, and the sampling control signal SSAM maintains a gate-off voltage.

In the period ①, the initialization switch SW1 and the second transistor ST2 are turned on to reset the second node N2 to the initializing voltage Vpre.

In the period ②, the first transistor ST1 is turned on to supply a compensation data voltage MDATA1 and MDATA2 to the first node N1. At this time, the second node N2 maintains the initialization voltage Vpre through the second transistor ST2. Therefore, in this period, the gate-source voltage Vgs of the driving transistor DT is programmed to a desired level.

In the period ③, the first and second transistors ST1 and ST2 are turned off, and the driving transistor DT generates a driving current Ioled at a programmed level and applies it to the organic light emitting diode OLED. The organic light emitting diode OLED emits light at a luminance corresponding to the driving current Ioled to display a gray scale.

In the organic light emitting diode display according to the disclosure, a compensation period is located outside the display period DF. The compensation period may belong to the first and second non-display periods X1 and X2 or the vertical blank period VB. During the compensation period, the data driver 12 extracts a threshold voltage Vth of the driving transistor DT, and calculates an amount of change of the threshold voltage Vth based on the extracted threshold voltage Vth to generate the compensation data voltage.

The compensation period according to the invention includes a first compensation period and a second compensation period. The first compensation period is a period for compensating a threshold voltage Vth of a driving transistor DT belonging to a first pixel P1. The second compensation period is a period for compensating a threshold voltage Vth of a driving transistor DT belonging to a second pixel P2.

The first and second compensation periods each include a programming period Tpg, a sensing period Tsen, and a sampling period Tsam.

Figure 6:
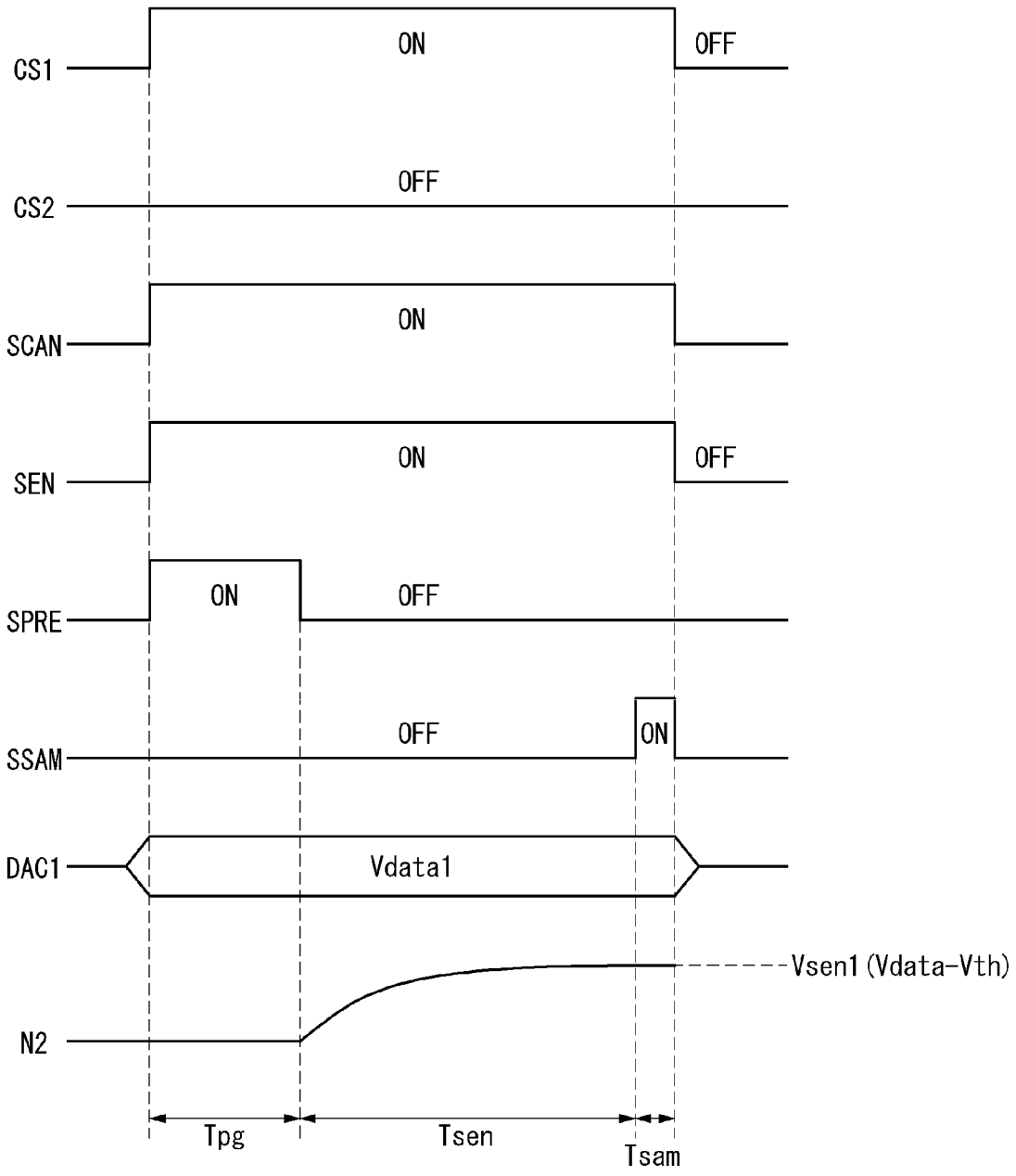
FIG. 6 is a diagram illustrating timings of control signals during a first compensation period according to an embodiment of the disclosure.
Figure 7A:
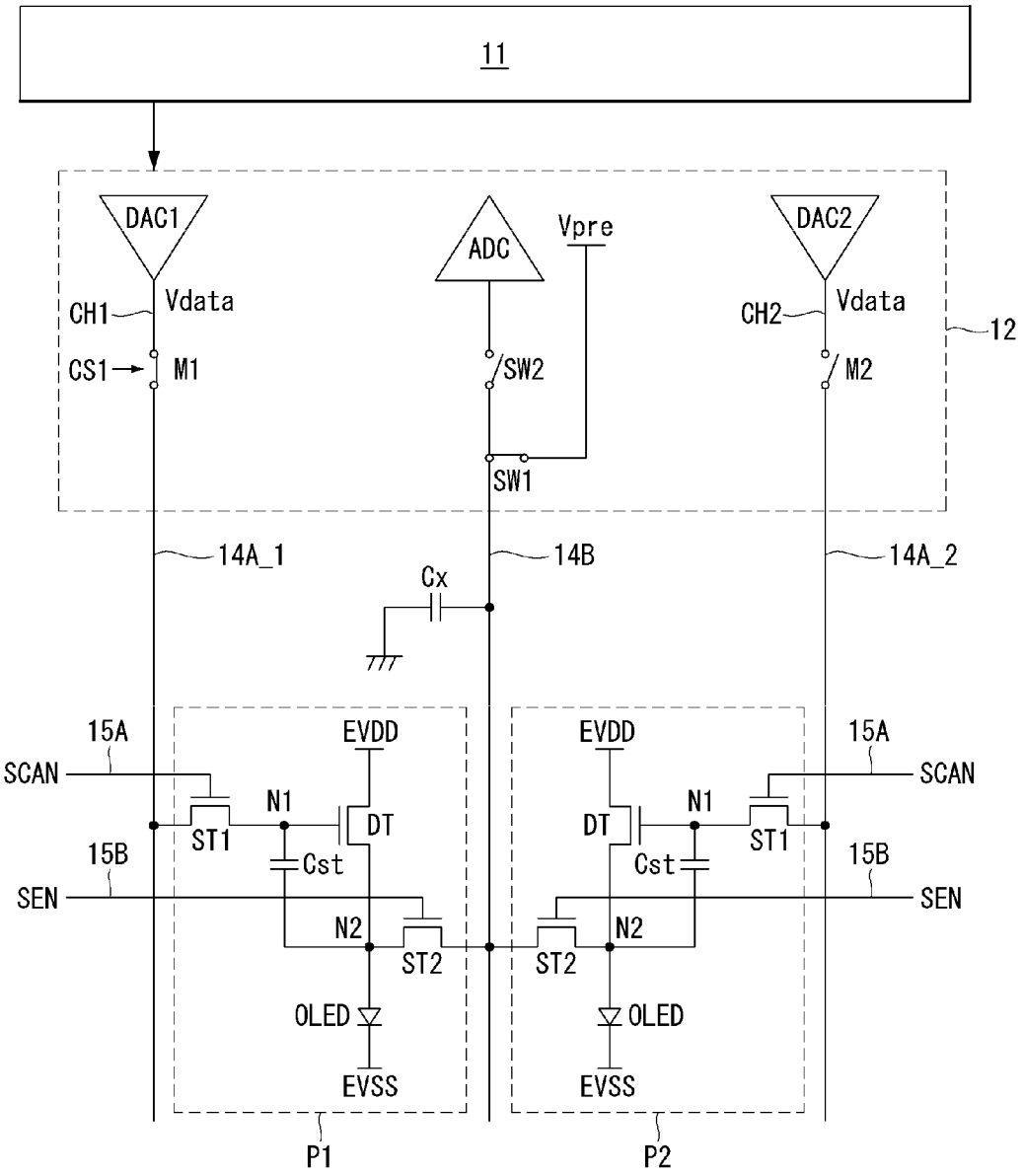
FIGS. 7A to 7C are diagrams illustrating operations of first and second pixels depending on control signals shown in FIG. 6 according to an embodiment of the disclosure.
Figure 7B:
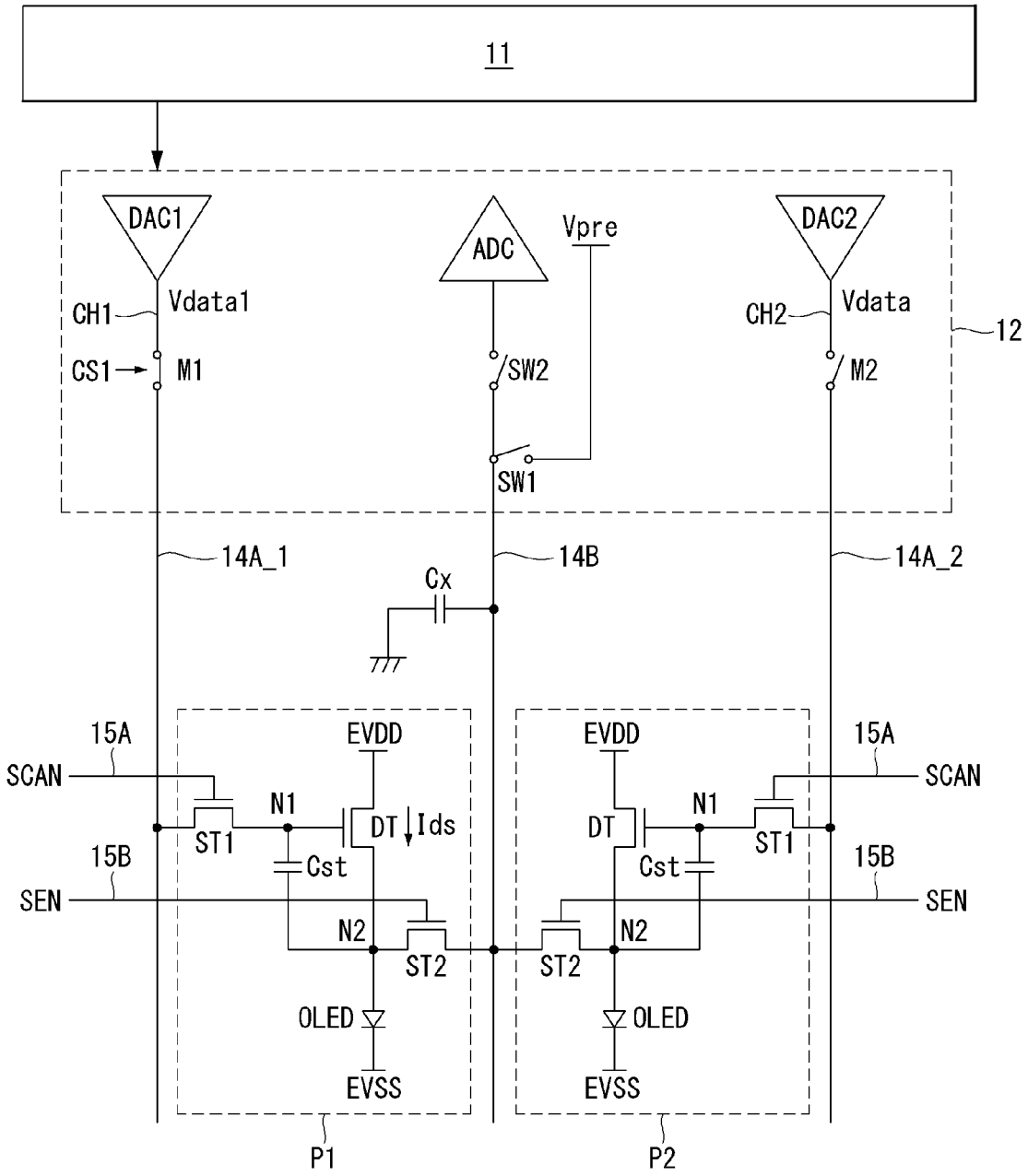
Figure 7C:
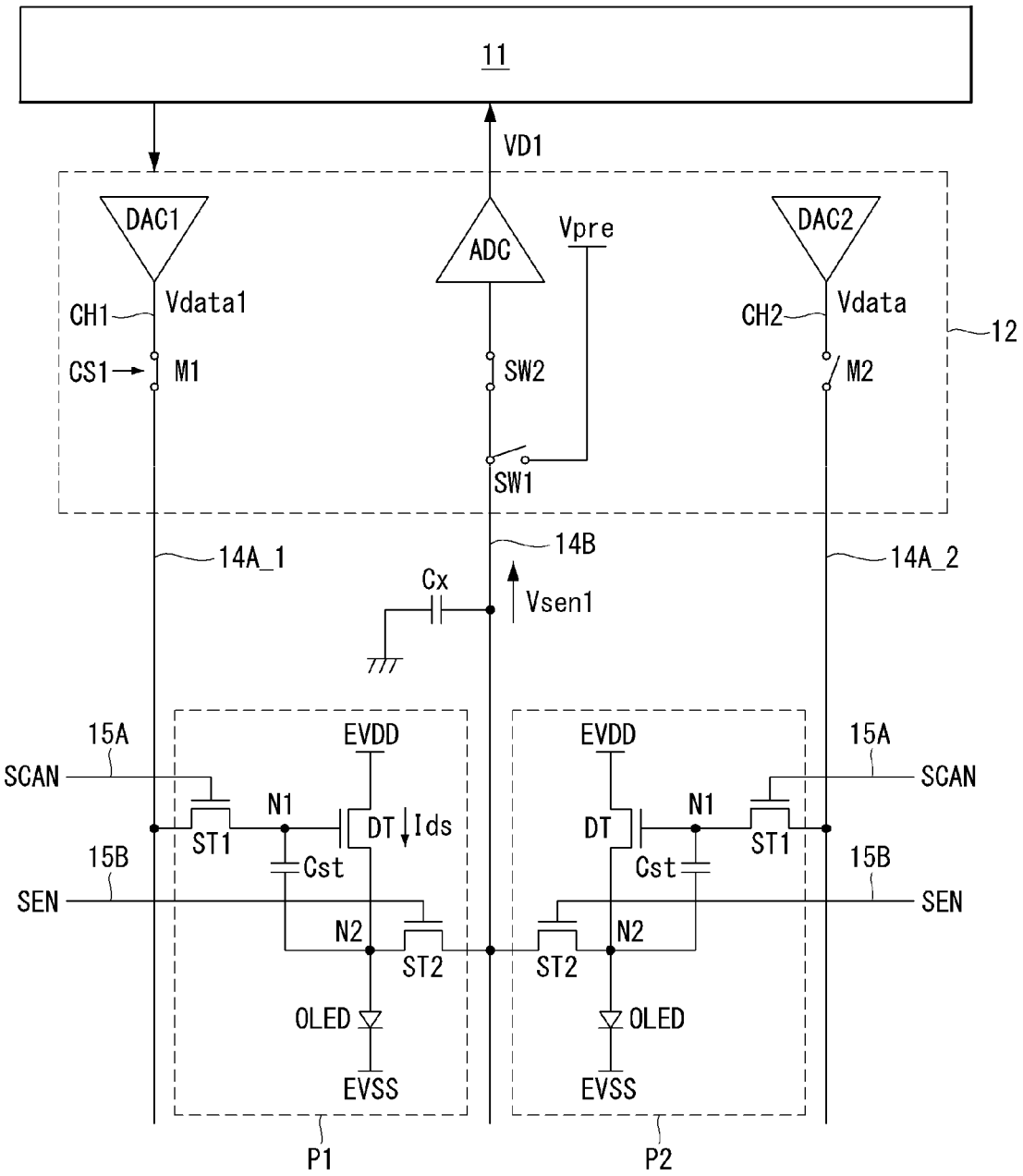

FIG. 6 is a diagram illustrating a first compensation period according to an embodiment of the disclosure. FIGS. 7A to 7C are diagrams illustrating pixel operation in a programming period Tpg, a sensing period Tsen, and a sampling period Tsam, respectively. The first compensation period is a period for compensating driving characteristics of a first pixel P1. For example, the first compensation period includes acquiring a source voltage of a driving transistor DT belonging to the first pixel P1 as a first sensing voltage Vsen1, and detecting a threshold voltage Vth of the driving transistor DT based on the first sensing voltage Vsen1.

Referring to FIG. 6 and FIG. 7A to FIG. 7C, operation of the first compensation period will be described below.

Referring to FIGS. 6 and 7A, in the programming period Tpg, a gate-source voltage of the driving transistor DT is set to turn on the driving transistor DT. To this end, first and second scan signals SCAN and SEN and an initialization control signal SPRE are input at a gate on level and a sampling control signal SSAM is input at a gate off level. Accordingly, a first transistor ST1 is turned on to supply a sensing data voltage Vdata output from a first digital-to-analog converter DAC1 to a first node N1, and an initialization switch SW1 and a second transistor ST2 are turned on to supply an initialization voltage Vpre to a second node N2. At this time, a sampling switch SW2 is off.

Referring to FIGS. 6 and 7B, in the sensing period Tsen, a voltage in a state in which the source voltage of the driving transistor DT rising due to a current Ids flowing through the driving transistor DT is saturated is detected as the first sensing voltage Vsen1. In the sensing period Tsen, the gate-source voltage of the driving transistor DT must be kept constant for accurate sensing. To this end, the first scan signal for sensing SCAN is input at the gate on level, the second scan signal for sensing SEN is input at the gate on level, and the initialization control signal SPRE and the sampling control signal SSAM are input at the gate off level. In the sensing period Tsen, a voltage of the second node N2 is increased by the current Ids flowing through the driving transistor DT. As the voltage of the second node N2 increases, a voltage of the first node N1 also rises.

Referring to FIGS. 6 and 7C, in the sampling period Tsam, the source voltage of the driving transistor DT stored in a sensing capacitor Cx is supplied to an analog-to-digital converter (ADC) as the first sensing voltage Vsen1 for a predetermined time. To this end, the second scan signal SEN and the sampling control signal SSAM are input at the gate on level, and the initialization control signal SPRE is input at the gate off level.

Thus, a second control signal CS2 maintains a gate off voltage during the first compensation period for compensating the driving characteristics of the first pixel P1. As a result, a second switch M2 maintains a turn-off state during the first compensation period, and a current path between a second data line 14A-2 and a second output channel CH2 is blocked. That is, the second data line 14A-2 becomes a floating state during the first compensation period.

Since the second data line 14A-2 is floated during the first compensation period, the ADC can more accurately extract the first sensing voltage Vsen1 even if a short circuit occurs between a reference voltage line 14B and the second data line 14A-2.

An effect of the short circuit between the reference voltage line 14B and the second data line 14A-2 on the first sensing voltage Vsen1 in the first compensation period will be described below.

In the first compensation period, the ADC acquires the threshold voltage Vth of the first pixel P1 based on the first sensing voltage Vsen1 extracted during the sampling period Tsam. Since the reference voltage line 14B is also connected to a second pixel P2, a voltage of a second node N2 of the second pixel P2 may affect the first sensing voltage Vsen1 within the first compensation period. Since a conventional organic light emitting diode display does not have the second switch M2 connecting the second output channel CH2 and the second data line 14A-2, the conventional organic light emitting diode display applies black data to the second pixel P2 to exclude a potential influence of the second pixel P2 during the first compensation period. When the black data is applied to the second pixel P2, the second pixel P2 does not operate, the first sensing voltage Vsen1 reflecting the threshold voltage Vth of the driving transistor DT belonging to the first pixel P1 during the first compensation period can be acquired.

However, when the reference voltage line 14B and the second data line 14A-2 are short-circuited, a current flowing through the reference voltage line 14B flows into the second data line 14A-2, and the first sensing voltage Vsen1 of the voltage line 14B is changed. That is, it is difficult to exactly grasp a magnitude of the threshold voltage Vth of the driving transistor DT belonging to the first pixel P1.

On the other hand, the data driver 12 according to an embodiment of the disclosure includes the second switch M2, and turns off the second switch M2 during the first compensation period to float the second data line 14A-2. When the second data line 14A-2 is floated, a parasitic capacitance is formed between the reference voltage line 14B and the second data line 14A-2. Thus, when the parasitic capacitance between the reference voltage line 14B and the second data line 14A-2 is formed, a potential of the second data line 14A-2 rises to a level equivalent to a potential of the reference voltage line 14B by the coupling phenomenon in a process of acquiring the first sensing voltage Vsen1 from the reference voltage line 14B in FIG. 7C. As a result, an amount of current flowing through the short circuit between the reference voltage line 14B and the second data line 14A-2 becomes negligible. Accordingly, the first sensing voltage Vsen1 of the first pixel P1 with a more accurate value can be acquired during the first compensation period, and accordingly, the threshold voltage Vth of the driving transistor DT belonging to the first pixel P1 can be calculated.

FIG. 6 illustrates timings of the control signals during the first compensation period for detecting the driving characteristics of the first pixel P1 among the embodiments of the invention. After the first compensation period, a second compensation period for detecting driving characteristics of the second pixel P2 proceeds. The second compensation period also proceeds to a programming period Tpg, a sensing period Tsen, and a sampling period Tsam. First and second scan signals SCAN and SEN, an initialization control signal SPRE, and a sampling control signal SSAM in the second compensation period have the same timings as shown in FIG. 6. During the second compensation period, the second control signal CS2 maintains a gate on voltage so that the second switch M2 is turned on. Then, a first control signal CS1 maintains a gate off voltage, and the first data line 14A-1 becomes a floating state. As a result, the second pixel P2 during the second compensation period performs the same operation as the first pixel P1 during the first compensation period, and the reference voltage line 14B acquires a second sensing voltage Vsen2. The ADC detects a threshold voltage Vth of a driving transistor DT belonging to the second pixel P2 based on the second sensing voltage Vsen2.

The present disclosure has been described with reference to an embodiment in which one reference voltage line is shared by two pixels. However, the technical idea of the invention is not limited to the number of pixels sharing the reference voltage line. The embodiment of the disclosure may be applied to an organic light emitting diode display in which one reference voltage line is shared by three or more pixels. For example, when one reference voltage line is shared by four pixels and first to fourth data lines are connected to first to fourth pixels, respectively, each of the first to fourth data lines is selectively connected to a data driver through a switch. Then, during a compensation period of the first pixel, second to fourth switches are turned off, and the data lines connected to the second to fourth pixels remain in a floating state. In this way, a voltage change of a sensing voltage can be reduced in a process of sequentially compensating driving characteristics of the pixels sharing the reference voltage line.

Although the embodiment of the disclosure has been described with reference to the embodiment in which the first and second switches M1 and M2 belong to the data driver 12, positions where the first and second switches M1 and M2 are disposed are not limited thereto. The first and second switches M1 and M2 may be regarded as separate components from the data driver 12. For example, the first and second switches M1 and M2 may be disposed on the display panel 10.

Although embodiments have been described with reference to a number of illustrative embodiments thereof, it should be understood that numerous other modifications and embodiments can be devised by those skilled in the art that will fall within the scope of the principles of this disclosure. More particularly, various variations and modifications are possible in the component parts and/or arrangements of the subject combination arrangement within the scope of the disclosure, the drawings and the appended claims. In addition to variations and modifications in the component parts and/or arrangements, alternative uses will also be apparent to those skilled in the art.

What is claimed is:

1. An organic light emitting diode display comprising:

a first pixel connected to a reference voltage line and a first data line;

a second pixel sharing the reference voltage line and connected to a second data line;

a data driver configured to output a data voltage to first and second output channels during a display period to display an image and acquire sensing voltages of the first and second pixels through the reference voltage line during a compensation period;

a first switch connected between the first output channel and the first data line; and a second switch connected between the second output channel and the second data line, wherein the first switch is turned on to connect the first data line to the first output channel and the second switch is turned off to float the second data line and to make a potential of the second data line rise to a level corresponding to a potential of the reference voltage line, during a first compensation period during which a sensing voltage representative of a driving characteristic of the first pixel is sensed by the data driver via the reference voltage line shared by the first pixel and the second pixel, wherein the second switch is turned on to connect the second data line to the second output channel and the first switch is turned off to float the first data line and to make a potential of the first data line rise to a level corresponding to a potential of the reference voltage line, during a second compensation period for performing external compensation of the second pixel after the first compensation period, and wherein the first compensation period and the second compensation period is non-overlapping with the display period.

2. The organic light emitting diode display of claim 1, wherein the first pixel includes:

a driving transistor including a gate electrode connected to a first node, a drain electrode connected to an input terminal of a high potential driving voltage, and a source electrode connected to a second node; and an organic light emitting diode connected to the second node, wherein the second node receives an initialization voltage in a programming period of the first compensation period, is saturated with the sensing voltage in a sensing period, and supplies the sensing voltage to the data driver in a sampling period.

3. The organic light emitting diode display of claim 2, wherein the data driver includes:

an initialization switch connected between the reference voltage line and an initialization voltage input terminal for inputting the initialization voltage; and a sampling switch connected between the reference voltage line and an analog-to-digital converter receiving the sensing voltage to acquire a digital sensing value.

4. The organic light emitting diode display of claim 3, wherein the initialization switch is turned on during the programming period, and the sampling switch is turned on during the sampling period.

5. The organic light emitting diode display of claim 2, wherein the first pixel further includes:

a first transistor connected between the first node and the first data line and being turned on in response to a first scan signal; and a second transistor connected between the second node and the reference voltage line and being turned on in response to a second scan signal, wherein the first and second transistors are turned on during the first compensation period.

6. A compensation method of driving characteristics of an organic light emitting diode display including a first pixel connected to a reference voltage line and a first data line and a second pixel sharing the reference voltage line and connected to a second data line, the first data line and the second data line being respectively supplied with data voltages from a first output channel and a second output channel of a data driver, comprising:

detecting a threshold voltage of a driving transistor belonging to the first pixel while connecting the first pixel to the first output channel through the first data line and floating the second data line to make a potential of the second data line rise to a level corresponding to a potential of the reference voltage line during a first compensation period; and detecting a threshold voltage of a driving transistor belonging to the second pixel while connecting the second pixel to the second output channel through the second data line and floating the first data line to make a potential of the first data line rise to a level corresponding to a potential of the reference voltage line during a second compensation period, and wherein the first compensation period and the second compensation period are non-overlapping with a display period of the organic light emitting diode display during which the organic light emitting diode display displays an image.

7. The compensation method of claim 6, wherein the floating the first and second data lines include blocking current paths between the first and second data lines and the first and second output channels, respectively.

* * * * *